US005803657A

United States Patent [19]

Hodgson

[11] Patent Number: 5,803,657

[45] Date of Patent: Sep. 8, 1998

[54] POWER TROWEL HANDLE MOUNTED CONTROLS

[76] Inventor: James A. Hodgson, 1321-42nd St., Sacrament, Calif. 95819

[21] Appl. No.: 690,251

[22] Filed: Jul. 24, 1996

[51] Int. Cl.[6] ..... E01C 19/22

[52] U.S. Cl. ..... 404/112

[58] Field of Search ..... 404/112, 83, 97; 451/353; 15/235.4, 235.8

[56] References Cited

U.S. PATENT DOCUMENTS

| | | | |
|---|---|---|---|
| 988,457 | 4/1911 | Glasscock | 404/97 X |
| 2,181,375 | 11/1939 | Leistner et al. | 404/112 |
| 2,289,247 | 7/1942 | Davis | 404/112 |
| 2,654,298 | 10/1953 | Ytterberg | 404/112 |
| 2,882,806 | 4/1959 | Thieme et al. | 404/112 |
| 3,732,590 | 5/1973 | Horst | 404/112 |
| 4,198,178 | 4/1980 | Carlstrom et al. | 404/112 |
| 4,271,093 | 6/1981 | Kobayashi | 261/34 R |
| 4,320,986 | 3/1982 | Morrison | 404/112 |
| 4,335,061 | 6/1982 | Kobayashi | 261/44 G |
| 5,372,542 | 12/1994 | Hodgson | 404/112 |

FOREIGN PATENT DOCUMENTS

| | | | |
|---|---|---|---|
| 635437 | 1/1962 | Canada | 404/112 |

*Primary Examiner*—James Lisehora

*Attorney, Agent, or Firm*—Westman, Champlin & Kelly, P.A.

[57] ABSTRACT

A power trowel handle has controls that permit electronically operating the functions of an engine on the power trowel from the handle. The engine includes a servo controlled carburetor which will permit injecting, upon initial closing, a circuit for starting a quantity of fuel for starting a two cycle engine, which normally has to be done manually, as well as permitting control of a throttle using a trigger switch on the handle. The power trowel further has an elongated pole braced with a slider to prevent twisting under torque and to permit better control of the power trowel from a remote handle. The handle grip is usable in either the elongated pole position, or directly on a shroud for the power trowel.

7 Claims, 3 Drawing Sheets

POWER TROWEL HANDLE MOUNTED CONTROLS

BACKGROUND OF THE INVENTION

The present invention relates to improvements in a manually operated power trowel including handle mounted controls, for performing all of the functions for the engine from a remote handle through electronic circuitry, and also improvements to guide the handle to provide a very stable platform against excessive torque generated by the trowel.

Various power trowels have been used for finishing concrete. These power trowels have a centrally mounted power unit such as an internal combustion engine, with a shroud and handle for rotating a troweling assembly which rotates about a vertical axis beneath the power unit and shroud.

The structure shown in U.S. Pat. No. 5,372,452 illustrates a small power trowel on which the present improvements are applied. The power trowel in patent '452 has an internal combustion (two-cycle) engine mounted on a shroud, and a remotely controlled throttle for the internal combustion engine utilizing a trigger switch at the handle. However, two-cycle engines used on power trowels have required manual setting the throttle to provide an initial input of fuel into the two-cycle engine. Setting the throttle manually to an open position provides an initial small charge of fuel for starting the engine. The present carburetors do include primer bulbs, but in most instances the initial setting of the throttle to introduce fuel into the intake manifold of the engine is sufficient for prompt starting.

The present invention has power actuated controls on a handle that can be used either on the remote end of a long pole that can be telescoping or fixed length, or the handle can be used directly on the shroud similar to that shown in patent '452. However, the handle is made very stable by providing a guide, operating preferably on a non-circular elongated handle to provide the functions remotely from the engine for satisfactory operation.

SUMMARY OF THE INVENTION

The present invention relates to a two-cycle engine control, as shown for use with a lightweight power trowel that has blades rotating about a vertical axis, and which has an outer shroud for providing a support for an internal combustion engine driving the blades. The trowel is operated through a ergonomically satisfactory D-grip type handle that includes electronic controls for operating the carburetor of the two-cycle engine, not only for the throttle or speed control, but also for initial starting and introduction of an initial charge of fuel into the engine.

The starting control on the handle further includes an electric starter for the internal combustion engine, which is preferably a two-cycle engine.

An elongated pole is braced with a sliding brace that closely fits around the handle and provides transfer of torque from the trowel blades to the pole through braces that are spaced outwardly from the center of the shroud in order to stabilize the machine more easily.

The handle is formed in a fashion that permits operator comfort, by having the D-shaped handle engage the long telescoping pole at a suitable angle so that the handle grip portion can be held upright while the pole tapers downwardly. This same handle can be removed from the elongated pole, the pole removed from the shroud and then the handle attached to the shroud.

DETAILED DESCRIPTION OF THE PREFERRED EMBODIMENTS

Figure 1:
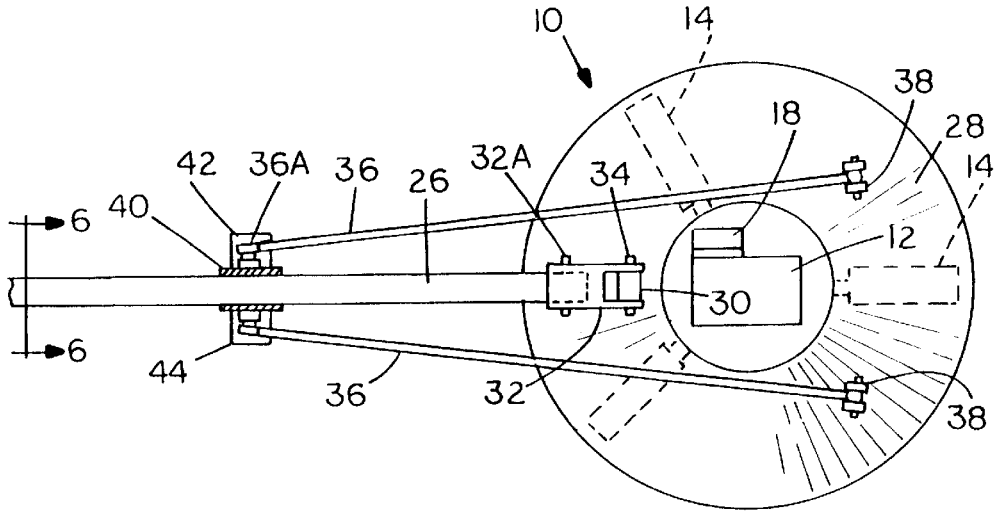
FIG. 1 is a top plan view of a power trowel having a two-cycle engine control made according to the present invention installed thereon.
Figure 2:
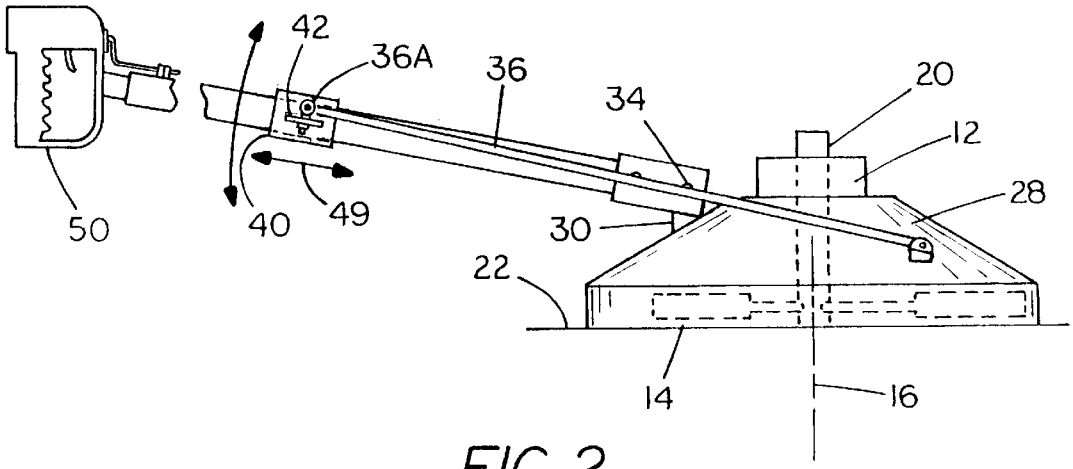
FIG. 2 is a side elevational view of the trowel of FIG. 1.

A lightweight, easy to use power trowel is shown generally at 10 in FIGS. 1 and 2, and an engine, preferably a two-cycle engine indicated at 12 is used for powering suitable trowel blades which are shown only in dotted lines at 14, and which can be mounted on a shaft and driven about a vertical axis indicated at 16 for troweling a surface on which the unit is resting.

The engine 12 has a battery pack and starter assembly 18 thereon as is commercially available, and also includes a carburetor 20, which as will be explained has a servo motor control for the throttle. Suitable gear reducers or other drives can be used for driving the troweling blades 14.

The troweling blades 14 will trowel a surface indicated at 22 in the manner described in U.S. Pat. No. 5,372,452, and these blades are made in that same manner.

An elongated control pole 26 is mounted on a housing or shroud 28, which forms a main support frame for the engine and trowel blades using a bracket 30 that is fixed to the shroud and may be suitably reinforced with respect to the shroud. The bracket 30 is held securely in position so that a coupler 32 can be pivotally mounted about a horizontal pivot axis with a pin 34 to the bracket 30. The pole 26 is slidably received in the coupler 32, and held in place with a pin 32A.

The pole 26 can be telescoping or made in sections, if desired, or can be a single length long pole, as shown broken away in FIG. 2. The pole 26 is also partially supported and braced with a pair of brace arms 36, which are mounted on the suitable brackets 38 also attached to the shroud 28, but on an opposite side of the central plane of the shroud from the bracket 30. As shown these brackets 38 are spaced apart adjacent the edge of the shroud 28 opposite the attachment side for the bracket 30. Arms 36, 36 are pivotally connected to the brackets 38 through suitable spherical rod end members, or similar connectors which will give a swiveling motion. The arms 36 then are connected to a slider 40 through ears 42 and, again, suitable rod end supports 44 (see FIG. 6). The rod end supports are fastened onto the ears 42 in a normal manner utilizing a bolt or a stud, and then the ends 36A of the arms 36 are bolted to the rod end members 44 so that the connection back to the slider 40 is a swivel type connection for the arms.

Figure 6:
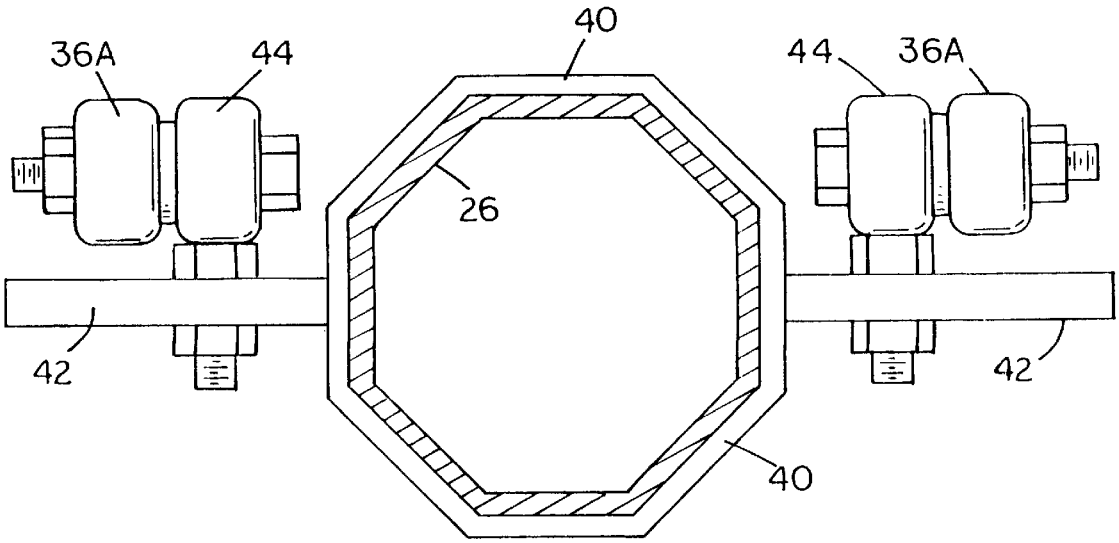
FIG. 6 is a sectional view of an elongated pole taken on line 6—6 in FIG. 1.

As can be seen in FIG. 6, the pole 26 and the slider 40 are both non circular in cross section and fit closely. As shown the cross sectional is hexagonal, but it can be any suitable non circular configuration so there is a resistance to twisting about the central axis of the pole 20, when a twisting load is reacted to the slider 40. The slider 40 is attached with a very close fit to the pole for insuring that torque tending to twist the pole about its longitudinal axis will be carried back to the pole 26 without any looseness, but yet the slider will slide so that the pole 26 can pivot about the axis of the pin 34 without hinderance. The slider 40 will slide up and down the pole 26 as the pole pivots occur.

The braces or arms 36, as shown, are spread where they are fastened to the brackets 38 so that there is a stable base for the braces to transfer torque loads tending to twist the shroud about a vertical axis, as well as about a generally horizontal axis back to the pole 26. When the trowel blades 14 are loaded, there is a torque load that has to be resisted by the pole to prevent the shroud from rotating with the blades and the braces 26 greatly stabilize the trowel when the long pole is being utilized in particular, and thus aid in controlling the power trowel housing.

The direction of movement of the slider is axially along the pole 26 as indicated by the double arrow 49 in FIG. 2.

Figure 5:
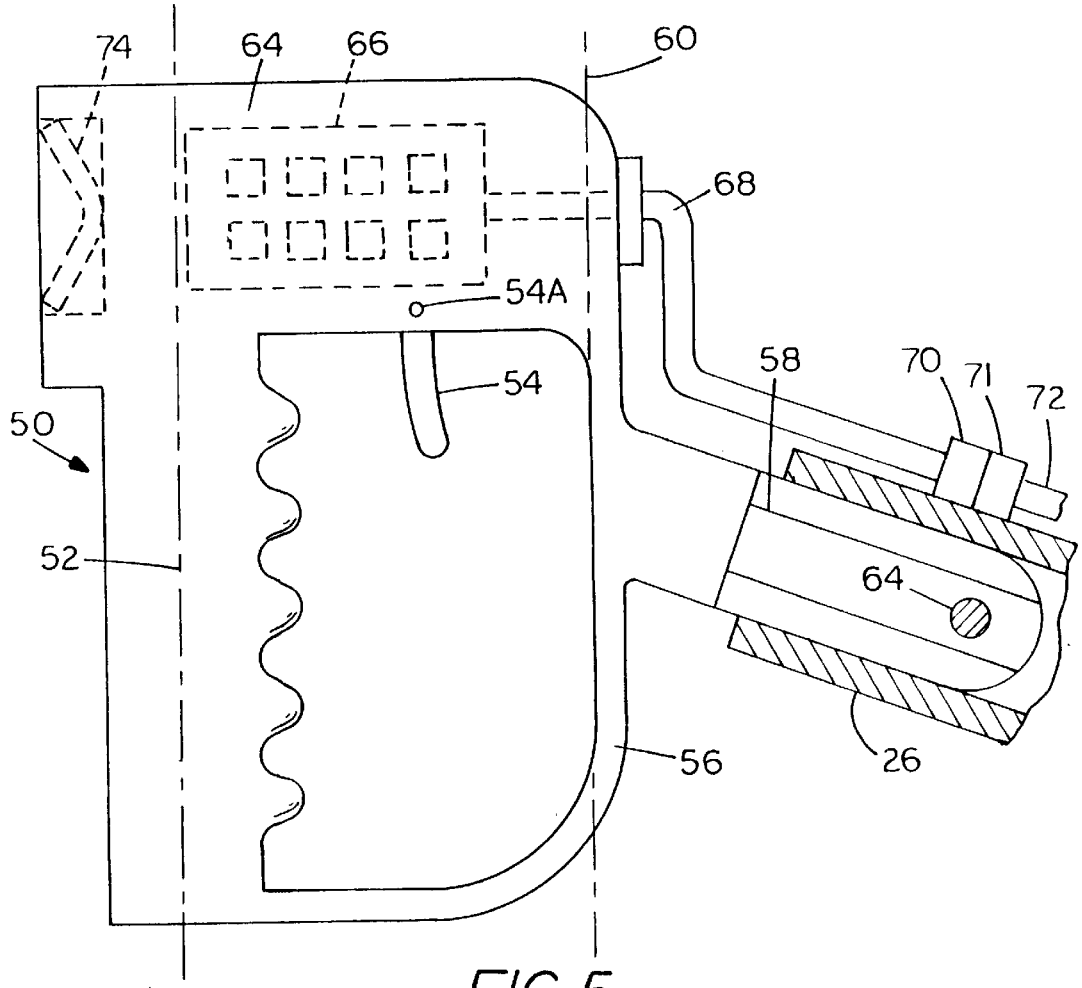
FIG. 5 is an enlarged side elevational view of a handle used with the present invention.

The pole 26 and the engine 12 are controlled by an operator using an ergonomically designed D handle 50 that is removably coupled to the pole 26, as shown perhaps best in FIG. 5. The D handle has a grip portion 52 that is configured for gripping by the hand of an operator, together with a throttle trigger switch 54, which is used on a rheostat or other similar variable signal controls to provide a proportional current to a servo motor used for operating the throttle on the carburetor 20 on the trowel. The D handle has a frame 56 with an outwardly extending tang 58, which as shown, is inclined downwardly to simulate the angle between the D handle from a vertical line along the handle frame indicated at 60, to the central axis of the pole 26. This is about 180 below a horizontal position when the hand grip 52 is gripped in a hand and is held substantially vertically with a normal length pole 26.

The tang 58 is held in place on the pole 26 with a pin 64, the tang 58 closely fits inside the non circular cross section pole 26. This permits the operator holding the hand grip to exert a rotational resistance on the pole if the trowel tends to twist or move around the axis of the pole.

The D-shaped handle 50 has a circuit board chamber 66 at an upper end 64 of the handle, as indicated by the dotted lines. This is where the electrical components can be housed. A suitable electrical cable 68 is provided from the circuit board and components and through a plug or coupler 70 to receptacle or second coupler 71, which is connected coupled to a line 72 that extends down along the pole 26.

The reason for having couplers 70 and 71 is so that the D-shaped handle 50 may be removed from the long pole 26, and slipped into the coupling 32 by removing the pin 32A and taking the pole 26 out, and then slipping the handle tang into the coupler 32 so that the handle is very close to the trowel and can be used for fine finishing or very close control of the trowel.

The printed circuit board 66 will receive its power from the battery pack on the engine indicated at 18. The D-shaped handle 50 also has a housing at the top for a pair of side by side rocker switches 74 and 74A one of which is pushed for completing the ignition, circuit and also as will be explained, providing for an initial loading of fuel into the carburetor. The second switch 74A is a conventional starter switch.

Figure 3:
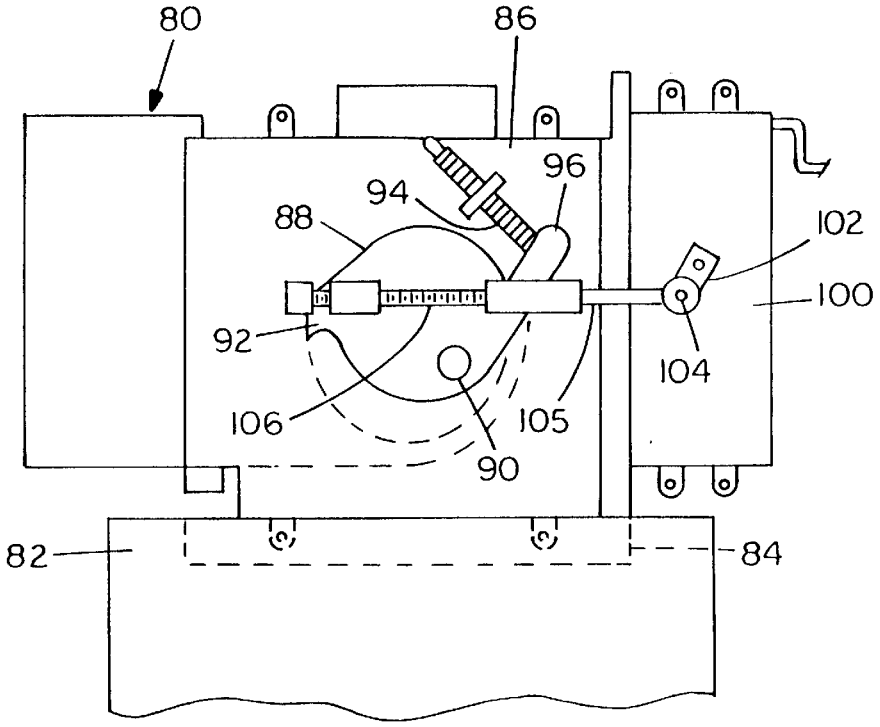
FIG. 3 is a part schematic representation of the top portion of a two-cycle engine used with the present invention showing a servo control for the throttle.

Referring to FIG. 3, a schematically shown carburetor 80 is illustrated on the top of a two-cycle engine 82 that is again merely schematically illustrated. The carburetor for this two-cycle engine is made by Walbro Fareast, Inc. and is generally made in the manner shown in U.S. Pat. No. 4,335,061, which utilizes a rotary type throttle valve, and which can have a suitable primer on it as well.

In this type of a carburetor, the throttle valve is moved to a full open position to provide an initial charge of fuel into the two-cycle engine intake manifold represented schematically in dotted lines at 84. This charging of the cylinder prior to starting has normally been done manually, and was done manually with the arrangement shown in U.S. Pat. No. 5,372,452. The '452 patent included a servo for the throttle control in the same manner as this disclosure.

The carburetor 80 includes a body 86 that is mounted on the two-cycle engine 82, and the throttle valve is a rotary valve represented by dotted lines 88, which is connected to a shaft 90 that has a throttle control lever 92 drivably mounted thereon. An idle stop or adjust screw 94 is utilized to engage an end portion 96 of the throttle lever 92.

A servo motor control indicated at 100 is used with this carburetor. The servo has a crank arm 102 that has a crank pin 104 connected to throttle link 105, which in turn, in the form shown, is connected to an adjustment screw 106 mounted on the throttle control lever 92. Crank arm 102 will move in proportion to current received by the servo 100 in a normal manner, and will, in effect, control the position of the rotary throttle valve 88 as a function of the drive current received. Further, this crank arm 102 can be moved to a full throttle open position initially for providing a charge of fuel into the internal combustion engine, as is normally done with a manual throttle control. The servo is made by Futaba of Taiwan, their part no. FP-5148 and is supplied with the carburetor.

Figure 4:
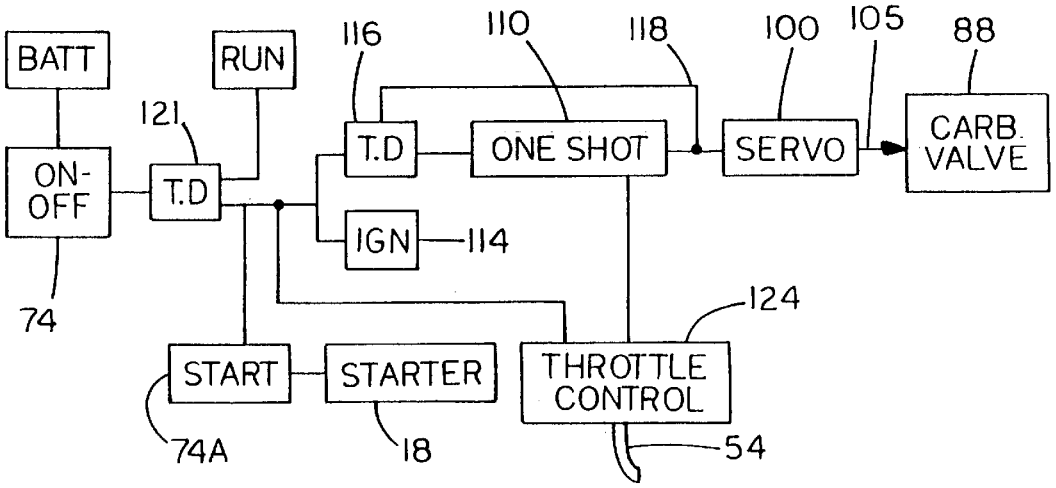
FIG. 4 is a block diagram representation of the control circuit used with the carburetor and servo of FIG. 3.

In order to control the servo 100 in a manner to permit starting the engine from the remote handle 50, the circuit board includes, as schematically shown in the block diagram of FIG. 4, a suitable circuitry including a one shot or similar electrical control indicated at 110 that will provide a "full open" amount of current to the servo 100, to operate the linkage 106 open the carburetor valve represented at 88 in the schematic diagram, through the operation of the lever 92 to its full open position by moving the servo arm 102.

The movement provides an initial charge of fuel each time the switch 74 is turned to this on position to also close the circuit to the ignition illustrated generally at 114.

The switch 74A is a starter switch which will energize the starter 18 to crank the two cycle engine and cause it to start after the initial charge of fuel has been provided.

In order to prevent flooding of the engine if the switch 74 is turned off and on, a time delay indicated at 116 is connected in the circuit between the on/off switch 74 and the one-shot 110. This time delay normally is closed so that the initial signal from the on/off switch 74 will reach the one-shot for energizing the servo, but once the one shot signal is provided, the time delay 116 is connected to the output of the one-shot through a line 118 and will start a preset time delay to prevent the one-shot from being fired a second time until a selected length of time has gone by.

Additionally, a time delay 121 is used in the main line from switch 74, which will disable the line from the on/off switch if the switch 74 is left on for too long of time. The time delay 121 is disabled if there is a "run signal" indicating the engine is running received before the time delay timeout. The run signal can be a signal from some engine component such as a generator or alternator.

A throttle control indicated at 124 using the trigger 54 is included in the D handle and will generally provide for a pivoting connection indicated generally at 54A in FIG. 6, which will in turn permit the trigger 54 to operate a variable resistance or other control that will vary the amount of current provided to the servo when the unit is energized. This throttle control is similar to that shown in U.S. Pat. No. 5,372,452.

The present arrangement provides stability for a wider variety of shrouds and bigger diameter troweling blades, using a remotely held pole. The control circuit provides electronic control of an engine completely from a remote handle so that a manual setting of the throttle or priming is not necessary before starting.

Although the present invention has been described with reference to preferred embodiments, workers skilled in the art will recognize that changes may be made in form and detail without departing from the spirit and scope of the invention.

What is claimed is:

1. A power trowel machine having a housing for surrounding a plurality of troweling blades, an extension pole pivotally mounted to said housing about a generally horizontal axis on one side of the housing and extending laterally from the housing;

a brace assembly for said pole comprising a pair of arms pivotally mounted on the housing on an opposite side thereof from the pivotal mounting of the pole, said mounting of said arms to said housing being spaced laterally apart in a direction parallel to the axis of pivoting of the pole, and a slider slidably mounted on said pole at a location between the first pivot and an outer end of the pole and slidable to permit the pole to pivot about its pivotal mounting, the arms being pivotally mounted to the slider about axes substantially parallel to the pivot axis of the extension pole to transfer loading of the arms under torque generated about an upright axis of the housing to the pole.

2. The power trowel of claim 1, wherein said pole and said slider have mating non circular cross sections about central axes thereof.

3. The power trowel of claim 2, wherein said arms are connected to said housing and to said slider through swivel connections.

4. The power trowel of claim 3, wherein said arms have a length that is at least three times the lateral dimension of the housing.

5. The power trowel of claim 1 and a D-shaped handle attached to an outer end of the pole.

6. The power trowel of claim 5, wherein said pole is mounted to said housing through a pivotally mounted coupler having an interior bore to receive one end of the pole, said D-shaped handle having a tang that fits into an outer end of the pole, and also fits into the coupler.

7. The power trowel of claim 1, wherein said housing has a generally circular periphery, and has a top portion that slopes upwardly from a lower end toward a central axis, said pole being pivotally mounted to said top portion on a first side of a vertical plane passing through a central axis of the housing and parallel to the pivot axis of said pole, and the mounting of said arms to said housing being on said top portion on an opposite side of the vertical plane from said pole.

* * * * *